US006854295B2

(12) United States Patent
Hofmann

(10) Patent No.: US 6,854,295 B2
(45) Date of Patent: Feb. 15, 2005

(54) LOOP-FORMING ELEMENTS FOR KNITTING AND WARP KNITTING MACHINES

(75) Inventor: Ulrich Hofmann, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 17 days.

(21) Appl. No.: 10/695,757

(22) Filed: Oct. 30, 2003

(65) Prior Publication Data

US 2004/0083767 A1 May 6, 2004

(30) Foreign Application Priority Data

Oct. 31, 2002 (DE) ..... 102 51 147
Nov. 20, 2002 (DE) ..... 102 54 217

(51) Int. Cl.[7] ..... D04B 35/06
(52) U.S. Cl. ..... 66/120; 66/123
(58) Field of Search ..... 66/116, 117, 120, 66/123, 124

(56) References Cited

U.S. PATENT DOCUMENTS 1,385,929 A * 7/1921 Scott ..... 66/13
RE15,741 E * 1/1924 Scott ..... 66/120
1,483,009 A * 2/1924 Page ..... 66/120
1,563,233 A * 11/1925 Scott ..... 66/120
2,685,785 A * 8/1954 Capdevila ..... 66/13
2,913,888 A * 11/1959 Amidon ..... 66/204
4,197,721 A 4/1980 Hofmann et al.
6,609,398 B2 * 8/2003 Plath ..... 66/120
2003/0121292 A1 7/2003 Plath

FOREIGN PATENT DOCUMENTS

DE 101 52 856 C1 4/2000
DE 101 12 277 C1 8/2002
DE 102 11 231 C1 4/2003
WO WO 02/072936 A2 9/2002

* cited by examiner

*Primary Examiner*—Danny Worrell
(74) *Attorney, Agent, or Firm*—Venable LLP; Stuart I. Smith

(57) ABSTRACT

An improved knitting tool, comprising a loop-drawing needle (2) and a transfer needle (3), is improved in terms of its operational reliability, its versatility of use, and its knitting speed, by providing that the loop-drawing needle (2) has a cheek region (12) which is widened compared to the rest of the shank (5) and which is provided with a noucat (16). On the end of the cheek region (12) remote from the hook (9) of the loop-drawing needle (2), a control face (36) is provided, along which the transfer needle (3) runs with its control face (37), as a result of which the spacing between the loop-drawing needle (2) and the transfer needle (3) changes. The transfer hook (26) of the transfer needle (3) is wider than the hook (9) of the loop-drawing needle, and the hook tip is sharpened or pointed in order to fit into the noucat (16) in the loop-drawing needle, Because the transfer hook (26) is embodied as especially wide, the operating safety is increased substantially.

13 Claims, 4 Drawing Sheets

41
42
43
44
45
46
47

41
47

41
44
49
48

48

41
51
52

41
53
54

41
52

LOOP-FORMING ELEMENTS FOR KNITTING AND WARP KNITTING MACHINES

BACKGROUND OF THE INVENTION

The invention relates to a loop-forming element, particularly for knitting and warp knitting machines.

For loop-forming machines, such as knitting or warp knitting machines, knitting tools are known that comprise a needle (also known as a loop-drawing needle) and a transfer needle. The loop-drawing needle and the transfer needle are provided with hooks pointing toward one another and are disposed in a common needle track. By a relative motion of the loop-drawing needle and the transfer needle, loops can be transferred between the two needles. The loop-drawing needle can also pull a loop that it has received through a loop received by the transfer needle (drawing a new loop through the old loop). An important factor here is that the hook tip of the loop-drawing needle find its way through the loop held by the transfer needle, without piercing the yarn itself.

One such knitting tool is known from International Patent Disclosure WO 02/072936 A2. The loop-drawing needle has a shank which is provided with a hook on the end. In the region of the hook, the shank is relatively slender, so that the hook width is less than the width of the rest of the shank of the loop-drawing needle. In the region of its cheek, the shaft of the loop-drawing needle is provided with a recess, which serves to receive the transfer hook of the transfer needle. The transfer hook, toward the tip of its hook, is provided with a step on both sides, forming a narrow, noselike protrusion that fits into the recess (noucat) embodied in the cheek of the loop-drawing needle.

In at least one embodiment of the knitting tool known from WO 02/027936, a control face is embodied adjoining the cheek of the loop-drawing needle, and a protrusion embodied on the transfer needle runs along this control face. When the protrusion moves past the ramplike control face, the spacing between the loop-drawing needle and the transfer needle changes. On the one hand, this creates the basis for the ability of the hook of the loop-drawing needle and the hook of the transfer needle to move past one another unhindered, and for the hook of the transfer needle on the other hand to plunge into the noucat embodied in the cheek of the needle. In this version, the needle hook is set back from the cheek by the amount of the penetration depth of the transfer hook; that is, the cheek height is higher, by the depth to which the transfer hook penetrates, than the upper edge of the hook of the loop-drawing needle. In another version known from the above patent disclose, the top edge of the needle hook is aligned with the cheek height, and the transfer hook in its return stroke executes a slight transverse motion to dip into the cheek of the needle. With this version, smaller loop heights can be achieved. To achieve the slight transverse motion, however, a spring prestressing means is provided, which permanently presses the transfer needle against the loop-drawing needle. Every relative motion in this case generates friction, which can cause unwanted heating.

With the prior art above as the point of departure, it is the object of the invention to create a knitting tool, of the type defined at the outset, which is not overly sensitive in terns of the loop forming process and especially with regard to the variety of yarns that can be used, and which is reliable and robust.

BRIEF SUMMARY OF THE INVENTION

This object is attained with the knitting tool of the invention. The special feature oat the knitting tool of the invention is the width of the transfer hook of the transfer needle and the width of the cheek region of the loop-drawing needle. Both the cheek region of the loop-drawing needl and the transfer hook are embodied as wider than the shank of the loop-drawing needle and of the transfer needle. The loop held by the transfer hook of the transfer needle is as a result spread apart so widely that the hook of the loop-drawing needle does not pierce the loop held by the transfer hook, even at a high operating speed and if very difficult yarns are being knitted. To that end, the needle track can be widened somewhat on its front end, that is, the end oriented toward the hook of the loop-drawing needle, so that the portion of the loop-drawing needle that is widened in the cheek region has enough space to run without jamming. On the other hand, even in this region the loop-drawing needle can experience guidance, if the widening of the cheek region is adapted to the greater width of the needle track in its front end region.

In a preferred embodiment, the shank of the loop-drawing needle is provided with a control face, which is associated with a control face embodied on the body of the transfer needle. The two control faces serve to lend the transfer needle a controlled transverse motion relative to the loop-drawing needle, in order to increase or decrease the spacing between the transfer needle and the loop-drawing needle in a controlled way during the process of operation. As a result, the transfer hook can dip in a controlled way into the noucat provided in the cheek of the needle, and as a result very slight loop heights can be achieved. The terms transverse motion and transverse direction are understood here to mean a motion in which the loop-drawing needle and the transfer needle approach or move away from one another.

The control faces can be embodied for instance as a ramp face and an associated cam. These can positively bring about an increase in the needle spacing between the loop-drawing needle and the transfer needle, but not an approach of the transfer needle to the loop-drawing needle. This problem can be remedied with a spring means that prestresses the transfer needle somewhat against the loop-drawing needle. In a preferred embodiment, however, the transfer needle is supported without stress on or next to the loop-drawing needle. A spring tensing device then serves to exert a transverse pressure on the transfer needle only when the transfer needle is to be brought against the loop-drawing needle.

In a preferred embodiment, the shank of the loop-drawing needle, in its cheek region, has a noucat which is embodied as a groovelike recess extending in the longitudinal direction. In cross section, this groovelike recess is preferably trapezoidal or wedge-shaped, and it thus widens in the direction of the top of the needle. A noselike protrusion which is embodied on the transfer hook and is preferably shaped approximately complementary to the noucat can then engage the recess. As a result, the transfer needle is guided on the loop-drawing needle. The protrusion engaging the noucat also facilitates the transfer of loops, resting on the needle cheek, by the transfer needle.

The transfer hook has a width that is greater than the width of the shank of the transfer needle. Preferably, the width of the transfer hook is even greater than the width of the hook and of the shank of the loop-drawing needle, in the end region 6 thereof as well as in the shank region located behind the cheek, as viewed from the hook. As a result, the loop to be transferred is held in a widely spread-apart form. The width of the hook of the loop-drawing needle is less than the width of the shank of the loon-drawing needle. A loop, when it is transferred from the interior of the hook of the loop-drawing needle to the widened cheek of the needle, is widened laterally and transferred in that state from the transfer hook. Piercing by the tip of the took of the loop-drawing needle of a loop that is held by the transfer needle need not be feared, even with difficult yarns and at a high operating speed.

Preferably, the width of the transfer hook matches the width of the cheek region. This provides favorable conditions in drawing the new loop through the old loop.

The cheek region of the loop-drawing needle and the transfer hook are preferably designed such that the transfer hook is guided on guide faces on both sides of the noucat. The corresponding hook regions of the transfer hook can be considered to be slide chamfers. Preferably, the dimensions of the loop-drawing needle and of the transfer needle are dimensioned such that the transfer hook runs on the guide faces with the least possible prestressing. This makes for greater security when a loop is being transferred.

The knitting tool of the invention exhibits only slight friction in the relative motion of the loop-drawing needle in the transfer needle. Friction losses are reduced to only a slight amount.

The elastic prestressing of the transfer hook, which is dependent on the working position of the knitting machine, increases the uniformity of the controlled transverse motion of the transfer needle, without additional calibration of any device on the needle cam. This makes for simple installation and adjustment of the needle cam and good uniformity of the knitted goods.

The portion of the transfer hook that engages the noucat can be embodied like a nose that protrudes in the direction of the hook. It thus forms a means for securely receiving a loop. It can be embodied especially finely, because the tensil stress on the yarn is absorbed by the reinforced, widened part of the transfer hook.

In a preferred embodiment of the knitting tool, the end toward the hook of the cheek of the needle is embodied as a rising face for the transfer hook. As a result, the tiniest loop heights can be achieved.

To assure the function and motion of the knitting tool in the longitudinal and transverse directions in the same needle guide track, the width of the transfer hook shank region, extending away from the hook, and the width of the loop-drawing needle shank region, adjoining the cheek region in the direction away from the hook, are essentially the same. As a result, it is possible to use one needle guide track of constant width over the entire guide height.

BRIEF DESCRIPTION OF THE DRAWINGS

Further details of advantageous embodiments of the invention will become apparent from the drawing, the description, or the dependent claims. In the drawing, exemplary embodiments of the invention are illustrated. Shown are:

DETAILED DESCRIPTION OF THE INVENTION

Figure 1:
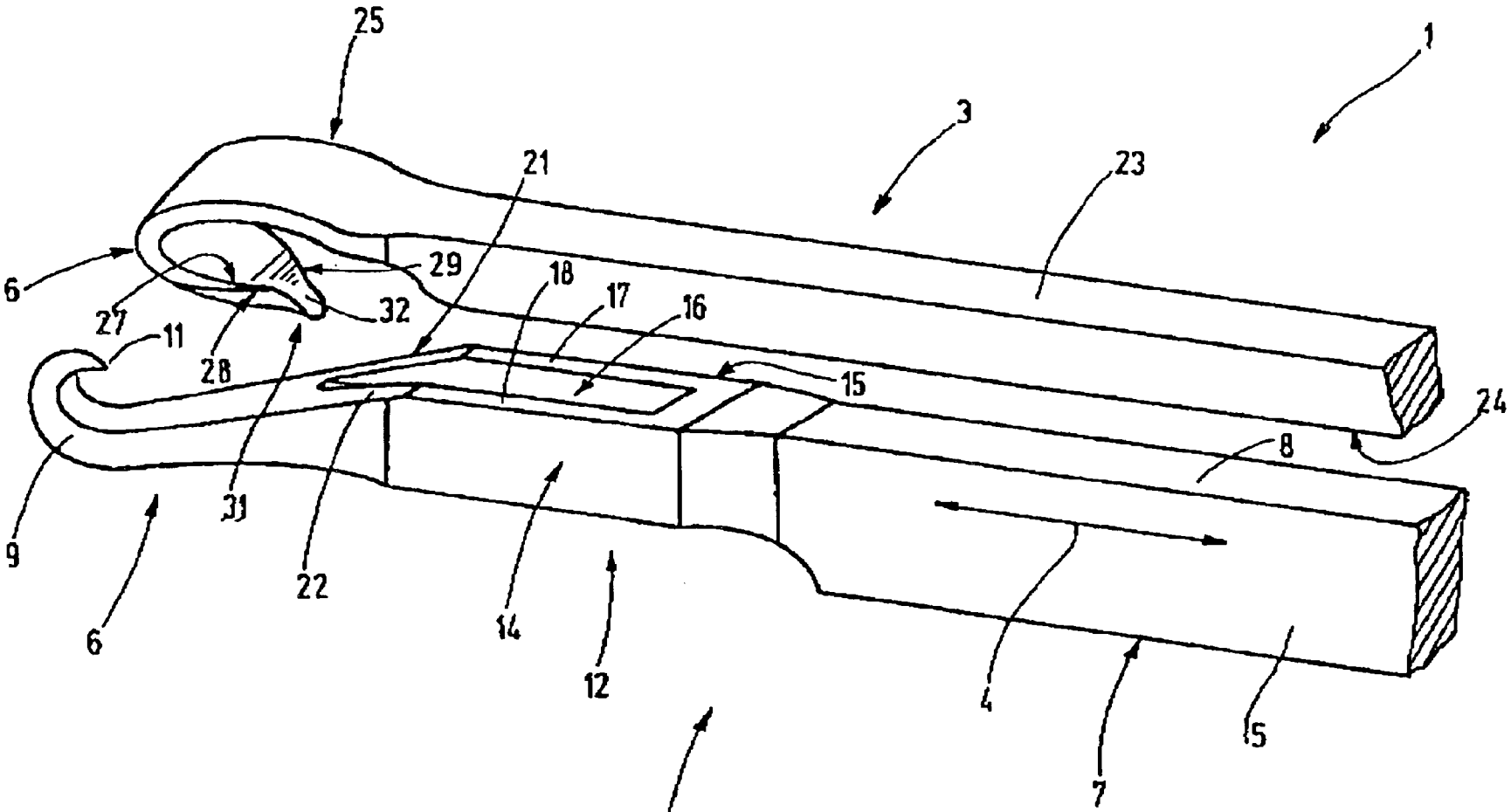
FIG. 1, a knitting tool in a basic perspective view.

In FIG. 1, a knitting tool 1 is shown, to which a loop-drawing needle 2 and a transfer needle 3 belong. Both needles are disposed in the needle track of a needle bed. The loop-drawing needle 2 has a shank 5, extending in elongated form along the longitudinal direction 4 of the loop-drawing needle, and this shank is provided on one end or some other suitable point, with an operating means, for instance in the form of a butt, that is not otherwise shown but extends away from the shank 5. The butt is in engagement with a cam that serves to drive the loop-drawing needle 2 back and forth in its longitudinal direction 4.

At its end 6, the shank narrows both in width and in height. The height is measured from the underside 7 of the needle to the ton 8 of the needle. The width is measured transversely to the height. A hook 9 is embodied on the end, and its tip is oriented toward the rear.

The shank 5 has a cheek region 12, which adjoins the end 6. The cheek region 12 has a width, to be measured between its two flanks 14, 15, which exceeds the width of the rest of the shank 5, that is, the portion extending to the rear from the cheek region 12, or in other words toward the drive device. Thus the cheek region 12 forms the widest portion of the loop-drawing needle 2. In particular, it also exceeds the width of the needle track that otherwise guides the shank 5. It is also wider than the hook 9.

On the top 8 of the needle, the cheek region 12 has a noucat 16, in the form of a groove extending in the longitudinal direction 4, centrally over the cheek region 12. On the end toward the hook 9, the groove comes to a shallow end. The groove bottom is essentially flat. On the top 8 of the needle, guide faces 17, 18 are found on both sides of the noucat 16 and are located in the same plane. This plane extends above the tip 11 of the hook 9. The hook is preferably located slightly below the groove bottom of the noucat 16. On the end of the noucat 16 toward the hook, the two guide faces 17, 12 change into rising faces 21, 22, which drop away toward the underside 7 of the needle and are thus farther away from the plane in which the guide faces 17, 18 are located. The rising faces 21, 22 preferably extend to below the height of the tip 11. In addition, the noucat 16, at least at its orifice, is wider, measured between the guide faces 17, 18, than the tip 11 of the hook 9.

The transfer needle 3 has a body 23 that likewise extends in the longitudinal direction 4 and that rests with its underside 24 on the top 8 of the needle. In this sense, FIG. 1 is an exploded view. The body 23 of the transfer needle 3 is provided with a drive device not otherwise shown, for instance in the form of a butt, which extends for instance at a right angle away from the body 23 and is in engagement with a needle track. The drive devices of the loop-drawing needle 2 and of the transfer needle 3 can lend them a relative motion to one another with respect to the longitudinal direction 4.

On its free end 25, the body 23 of the transfer needle 3 is provided with a transfer hook 26, whose width is preferably approximately equivalent to the width of the cheek region 12. Thus the transfer hook 26 is considerably wider than the body 23 of the transfer needle 3, which body forms a shank. This is particularly true for the part of its downward-oriented tip 27, which runs above the guide faces 17, 12. The tip 27 ends in guide chamfers 28, 29, which are formed by concave surface regions and are embodied on the underside of the tip, and which slide on the guide faces 17, 18 when the knitting tool 1 is in operation. The tip 27 thus comes to an end in a face oriented approximately horizontally, that is, approximately parallel to the top 8 of the needle. This horizontally oriented face is adjoined by an extension 31, which is embodied like a downward-pointing nose and protrudes downward between the guide chamfers 28, 29. This extension 31 is embodied as approximately complementary to the noucat 16 and can run into the noucat. On its side pointing toward the body 23, the extension 31 has an oblique surface 32, which is oriented at an acute angle to the longitudinal direction 4. Compared to the hook 9 of the loop-drawing needle 2, the transfer hook 26 or the transfer needle 3 is substantially wider, preferably twice as wide.

The knitting tool 1 described thus far functions as follows:

In operation, the transfer needle 3 rests with its underside 24 on the top 8 of the loop-drawing needle. It is assumed at first that the hook 9 has received a loop. The transfer hook 26 is located for instance between the hook tic 11 and the rising faces 21, 22. If the loop-drawing needle 2 and the transfer needle 3 are now moved in the outward direction (to the left in FIG. 1), the loop slides onto the guide faces 17, 18 of the cheek region 12 and is widened in the process. In the next step, the transfer needle 3 experiences a reverse motion, causing the protrusion 32 to enter the noucat 16 and pick up the loop located there. The loop then slides into the interior of the transfer hook 26. Approximately simultaneously, the hook 9 receives a yarn that can now be drawn through the loop received by the transfer hook 26, by means of a relative retraction of the loop-drawing needle 2 with respect to the transfer needle 3.

Because the transfer hook 26 is embodied as very wide compared to the hook 5 of the loop-drawing needle, the loop held by the transfer hook 26 is spread open so far that piercing of the yarn by the tip 11 is virtually precluded, even under adverse knitting conditions. The knitting tool 1 is thus suitable as a reliable knitting tool for both processing difficult yarns and attaining high operating speeds.

Figure 3:
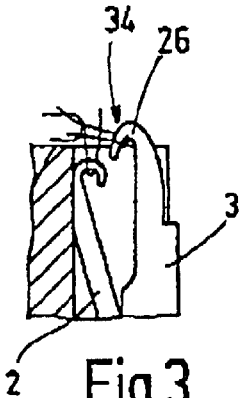
Figure 4:
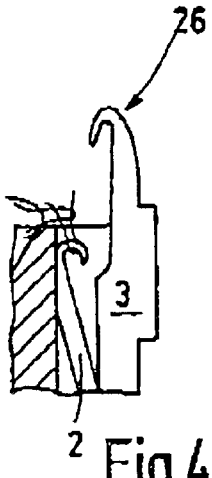
Figure 5:
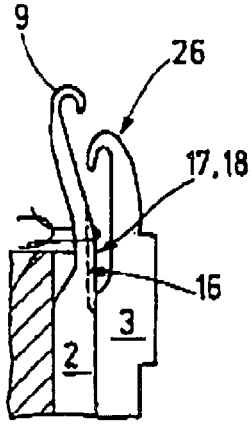

The various phases of loop formation are shown in FIGS. 2–5. While the loop-drawing needle 2 is driven outward and is catching a yarn 33, the transfer hook 26 is taking on a loop 34 that is resting on the needle cheek 12. FIG. 3 illustrates the pulling of the new loop through the old, in which the loop-drawing needle 2 draws its new loop, formed from the yarn 33, through the loop 34 located in the transfer hook 26. In the process, the transfer hook 26 moves past the hook 9 with some play. No transverse motion of the loop-drawing needle 2 and the transfer needle 3 toward one another takes place. FIG. 4 illustrates the state after the knockover of the loop 34 from the transfer hook 26, and FIG. 5 illustrates a state that occurs immediately before the state shown in FIG. 2. In the state in FIG. 5, the loop-drawing needle has been moved outward past the transfer needle 3, and the hook 9 has moved past the transfer hook 26 without touching it. This is achieved by means of a sufficient offset in height between the guide faces 17, 18 and the hook 9. The offset in height is the sum of the penetration depth of the transfer hook 26 into the noucat 16, plus an amount of play that assures that the hook 9 will moved past the transfer hook 26 without touching it, even when tolerances in terms of installation or function are involved.

Figures 6, 7, 8, 9:
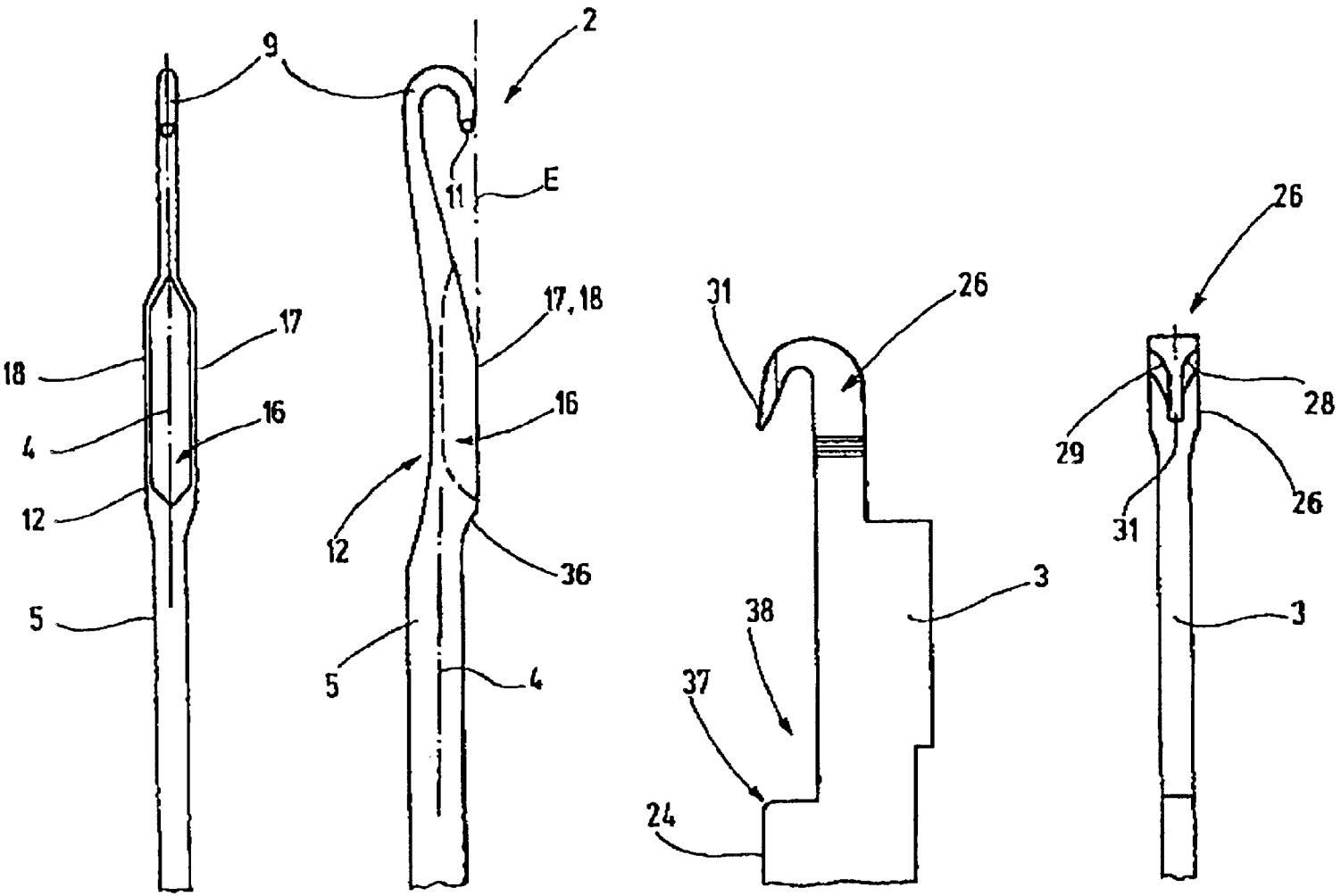
FIG. 6, a modified embodiment of a loop-drawing needle, belonging to the knitting tool, in top view.
FIG. 7, the loop-drawing needle of FIG. 6 in a side view.
FIG. 8, a transfer needle, belonging to the knitting tool, in a side view.
FIG. 9, the transfer needle of FIG. 8 in a view from below.

In FIGS. 6–9, a modified embodiment of the knitting tool of the invention is shown in various views. This embodiment matches the exemplary embodiment described above, particularly in terms of the width of the cheek region 12, the ratio of that width to the width of the shank 5 and to the width of the transfer hook 26 and to the hook 9. In particular the widening of the cheek region 12 compared to the shank 5, which is continuous over the entire needle height, can be seen from FIG. 6. Also, the hook 9 is preferably markedly slenderer than the shank 5. Preferably, it is less than half as wide as the cheek region 12. Conversely, the transfer hook 26 has a width that exceeds that of the shank 5 and that preferably matches the width of the cheek region 12. The guide faces 17, 18 are formed by relatively narrow edges, which merge in slightly rounded fashion with the noucat 16. The noucat can have a rectangular cross section, a cross section that tapers downward, a trapezoidal cross section, or a bell-shaped cross section. The guide faces 17, 18, as FIG. 7 shows, are located in a plane E that the hook 9 touches. The hook 9 can if needed also be located, with its tip 11, in this plane. To make it possible for the extension 31 of the transfer hook 26 to move past the hook 9, the tip of the extension 31 is located in the same plane as the underside 24, or at a certain margin of safety from it. If the transfer needle 3 is resting with its underside 24 on the guide faces 17, is, then between the hook 9 and the extension 31 of the transfer hook 26 there is a slight margin of safety, serving to compensate for tolerances, in a direction transverse to the longitudinal direction 4. For instance, the hook 9 is below the plane E while the extension 31 is above the plane E.

To enable the extension 31 to dip into the noucat 16, the shank 5 of the loop-drawing needle 2 is provided with a control face 36, which is for instance disposed adjacent to the cheek region 12 toward the shank 5, on the side remote from the hook 9, and which has an inclination to the longitudinal direction 4. The inclination of the control face 36 is such that this face forms a ramp, along which a second control face 37 that is provided on the transfer needle 3 can slide. The control face 37 is embodied for instance as a rounded place, at the transition between the underside 24 and a stepped recess 38, that is large enough to receive the protruding needle cheek when the underside 24 is resting on the shank 5 behind the control face 36. Transversely to the longitudinal direction 4, the control face 36 has a height that is at least as great as the desired penetration depth of the extension 31 into the noucat 16. The control face 36 can be straight in ramplike form or can be curved like an S in side view.

The guide chamfers 28, 29, which are partly concealed in FIG. 1, can also be seen in FIG. 9. They define the transfer hook 26 at the bottom and mark the transition from the transfer hook 26 to the protrusion 31.

Figure 10:
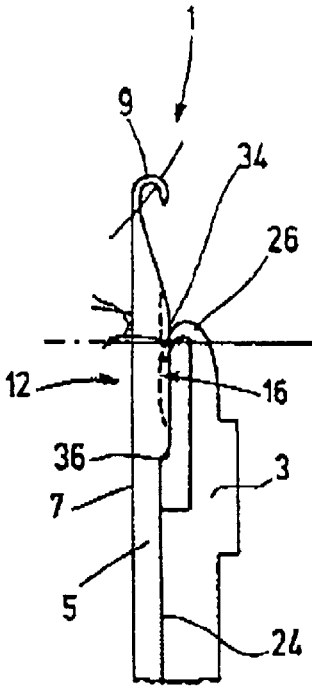
FIGS. 10–13, the knitting tool of FIGS. 6–9 in a loop forming operation in various phases of the work.

The operation of this knitting tool 1 can be seen from FIGS. 10–13. FIG. 10 illustrates the takeover of the loop 34 by the transfer hook 26 by the process described in conjunction with FIG. 2. The underside 24 of the transfer needle 3 rests on the shank 5 behind the control face 36, and as a result the protrusion 31 dips into the noucat 16. The guide chamfers 22, 29 can preferably rest on the guide faces 17, 18 with slight resilient prestressing. For the sake of simplicity, these latter reference numerals have been left out of FIG. 10. The protrusion 31 is thus located below the plane E, which is marked by the guide faces 17, 11 and up to which the hook 9 extends.

Figure 11:
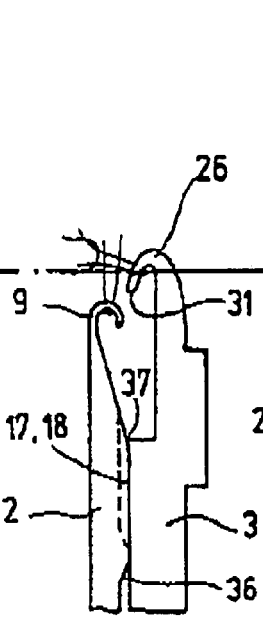

For drawing the new loop through the old one, the loop-drawing needle 2 is retracted in the longitudinal direction, as shown in FIG. 11. In the process, the control face 36 arrives at the control face 37 and thus presses the transfer needle 3 away from the loop-drawing needle 2. The pressing-away motion means a transverse motion of the transfer needle 3 relative to the loop-drawing needle 2. The stroke is long enough that the protrusion 31 of the transfer hook 26 is positioned above the plane defined by the needle cheek, or its guide faces 17, 18. It can thus move freely past the hook 9, and the hook 9 can move freely past the transfer hook 26.

Figure 12:
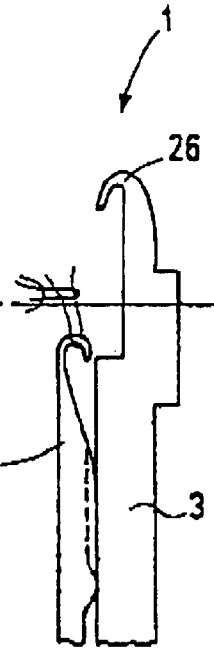

FIG. 12 shows the knitting tool 1 with the transfer needle 3 driven farther outward. In this state, the transfer hook 26 has cast off the newly formed loop, and the knitted fabric is suspended solely from the loop-drawing needle 2.

Figure 13:
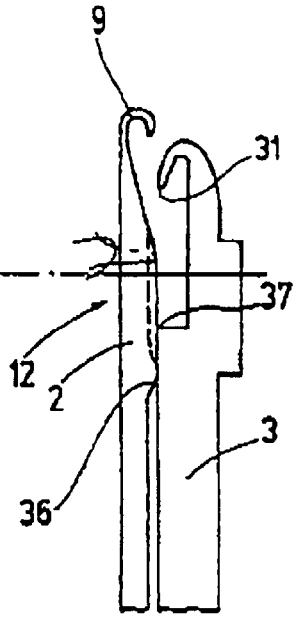
Figure 2:
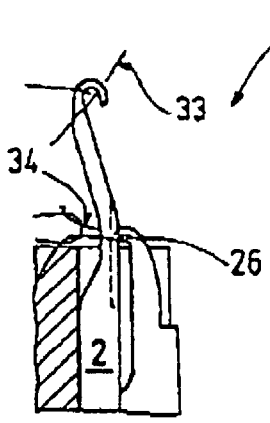
FIGS. 2–5, the knitting tool of FIG. 1 in a loop forming operation in various phases of the work.

FIG. 13 illustrates the driving outward of the loop-drawing needle 2. In this operation, the last loop of the knitted fabric slides onto the cheek region 12 to prepare for the loop takeover shown in FIG. 10. At the transition from the state in FIG. 13 to the state in FIG. 10, the second guide face 37 slides downward along the first guide face 36, as a result of which the transfer needle 3 rests on the loop-drawing needle 2, and the protrusion 31 dips into the interstice between the hook 9 and the cheek region 12 of the loop-drawing needle 2. Upon a further return stroke of the transfer needle 3, the protrusion 31 then enters the noucat 16, whereupon the guide chamfers 28, 23 slide along the rising faces 21, 22 (analogously to FIG. 1) and then arrive on the guide faces 17, 18.

The transverse motion of the transfer needle 3 that is required in the exemplary embodiment of FIGS. 6–13 can be attained by means of a statically acting spring means. However, it is considered advantageous instead to provide a spring means that exerts a spring force above all during the return stroke phase (the transition from the state in FIG. 13 to the state in FIG. 10). Ore such spring means is shown as an example in FIGS. 14 and 15.

The spring means 41 referred to is inserted for instance into a cam part of a cam for driving both the transfer needle 3 and the loop-drawing needle 2. It is disposed such that a pressure piece 42, provided on it, comes into engagement with the back of the transfer needle 3 essentially only whenever the control faces 36, 37 engage one another, and the transfer needle 3 is meant to approach the loop-drawing needle 2. The spring means 41 includes a receptacle 43, which is supported in the cam part. The receptacle 43 encloses an interior in which a slider 44 is supported in such a way that it can be displaced counter to the force of a compression spring 45. The compression spring preferably works without prestressing. Its position can be set by an adjusting screw 46 on which it is braced. By its other end, it is braced on the slider 44. The slider has a slide element 47 on its end, the sliding properties of which are optimized for the sake of cooperation with the transfer needle 3.

Figures 14, 15, 16, 17, 18, 19, 20:
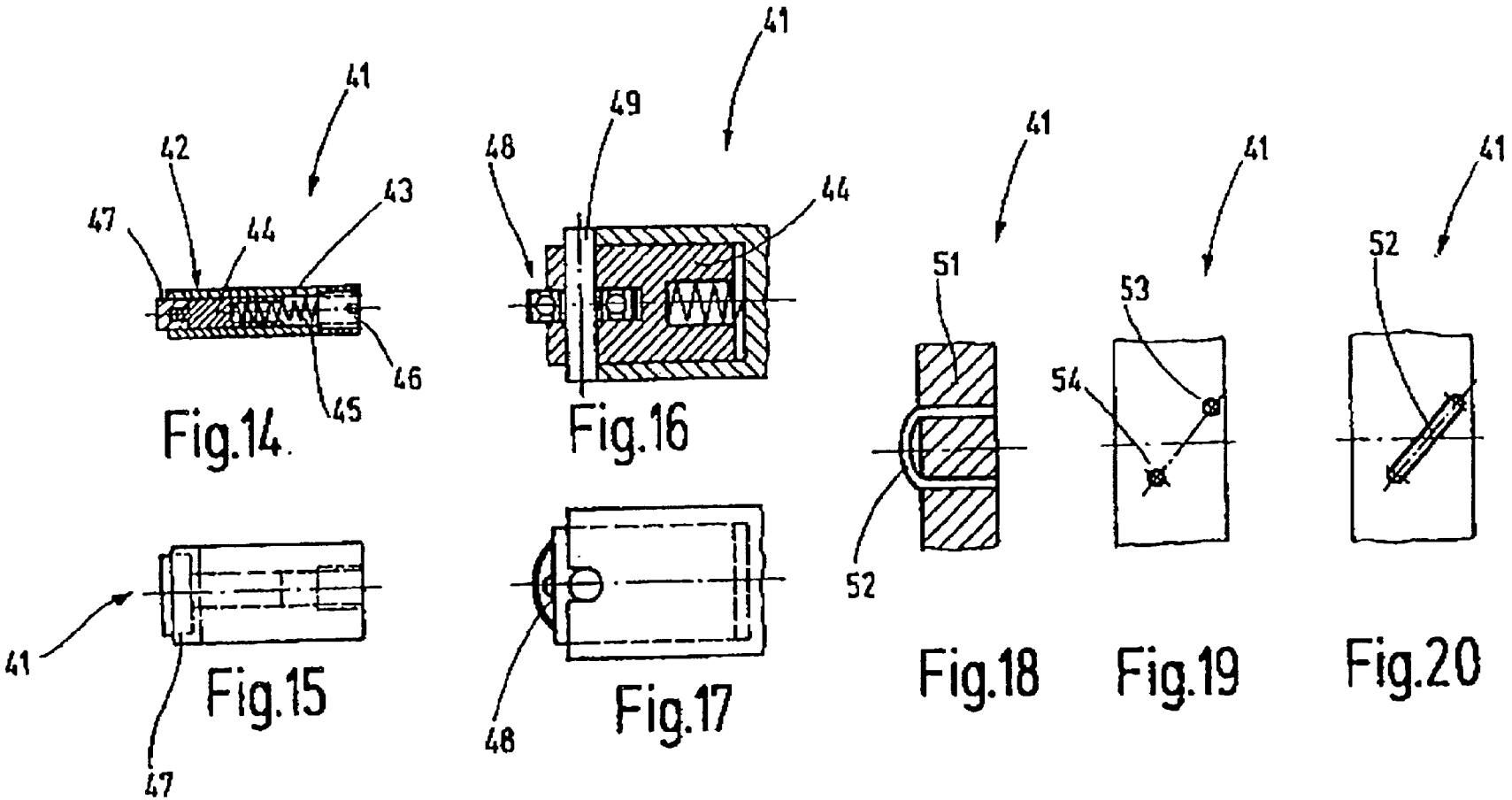
FIG. 14, a spring means, shown in cross section, that is to be attached to the needle cam.
FIG. 15, the spring means of FIG. 14 in a side view.
FIG. 16, a different embodiment of the spring means, shown in section.
FIG. 17, the spring means of FIG. 16 in a side view.
FIG. 18, a cam part with a mounted spring element, shown in section.
FIG. 19, the inside face of the cam part of FIG. 18 without the spring element.
FIG. 20, the cam part of FIG. 19 with the spring element.

FIGS. 16, 17 illustrate an alternative in which the slide element 47 is replaced by a ball bearing 48. The ball bearing is retained or the slider 44 via a pin 49. For the rest, reference is made to the description above.

FIGS. 18–20 illustrate a further alternative embodiment of the spring means 41. This is a cam part 51, into which a slide runner 52 is inserted. As can be seen from FIG. 18, the slide runner 52 can he inserted in the form of a hoop bent into a U into two bores 53, 54 in the cam part 51 (see FIG. 19). The slide runner 52 can be made from an elastic material, such as a polished flat wire or a polished round wire and can be coated to promote its sliding properties, or it can he embodied as a hose, for instance. As FIG. 20 shows, the slide runner 52 is preferably disposed somewhat obliquely compared to the cam part 51. The precise location will be determined by the needle track.

An improved knitting tool, comprising a loop-drawing needle 2 and a transfer needle 3, is improved in terms of its operational reliability, its versatility of use, and its knitting speed, by providing that the loop-drawing needle 2 has a cheek region 12 which is widened compared to the rest of the shank and which is provided with a noucat 16. On the end of the cheek region 12 remote from the hook 9 of the loop-drawing needle 2, a control face 36 is provided, along which the transfer needle 3 runs with its control face 37, as a result of which the spacing between the loop-drawing needle 2 and the transfer needle 3 changes. The transfer hook 26 of the transfer needle 3 is wider than the hook 9 of the loop-drawing needle, and the hook tip is sharpened or pointed in order to fit into the noucat 16 in the loop-drawing needle. Because the transfer hook 26 is embodied as especially wide, the operating safety is increased substantially.

List of Reference Numerals

1 Knitting tool
2 Loop-drawing needle
3 Transfer needle
4 Longitudinal direction
5 Shank
6 End
7 Underside of needle
8 Top of needle
9 Hook
11 Tip
12 Cheek region
14, 15 Flanks
16 Noucat
17, 18 Guide faces
21, 22 Rising faces
23 Body
24 Underside
25 End
26 Transfer hook
27 Tip
28, 29 Guide chamfers
31 Extension
32 Oblique surface
33 Yarn
34 Loop
36, 37 control faces
38 Recess
41 Spring means
42 Pressure piece
43 Receptacle
44 Slide
45 Compression spring
46 Adjusting screw
47 Slide element
48 Ball bearing
49 Pin
51 Cam part

52 Slide runner

53, 54 Bores

E Plane

What is claimed is:

1. A knitting tool, comprising:

a loop-drawing needle, which has an elongated shank that has a hook on one end and a cheek region spaced apart from the hook, which cheek region is widened compared to the rest of the shank, and the shank is provided with a drive means for effecting a longitudinal motion;

a transfer needle, which has an elongated body that parallel to the loop-drawing needle is supported displaceably against the loop-drawing needle and is provided with a drive means for effecting this longitudinal motion; and a transfer hook, which is embodied on one end of the elongated body of the transfer needle, and whose width measured transversely to the longitudinal direction exceeds the width of the hook.

2. The knitting tool of claim 1, wherein on the shank is a first control face, which at at least one point has an inclination to the longitudinal direction of the shank; and wherein on the body is a second control face, for entering into engagement with the first control face and for imparting a transverse motion relative to the loop-drawing needle to the transfer needle, beginning at the longitudinal relative motion.

3. The knitting tool of claim 1, wherein in the cheek region, the shank has a noucat, in the form of a groovelike recess extending in the longitudinal direction, and an extension embodied on the transfer hook is associated with this noucat.

4. The knitting tool of claim 1, wherein the transfer hook has a width that is greater than the width of the shank of the loop-drawing needle.

5. The knitting tool of claim 1, wherein the transfer hook has a width that is greater than the width of the body of the transfer needle.

6. The knitting tool of claim 1, wherein the transfer hook has a width that matches the width of the cheek region, measured from flank to flank.

7. The knitting tool of claim 1, wherein in the cheek region on the shank, at least one guide face is embodied, which extends in the longitudinal direction and is located in the same plane that the hook or the tip of the hook touches.

8. The knitting tool of claim 1, wherein in the cheek region on the shank, at least one guide face is embodied, which is located in a plane that is offset transversely to the longitudinal direction of the shank from the tip of the hook.

9. The knitting tool of claim 1, wherein the end toward the hook of the cheek region forms at least one rising face for the transfer hook.

10. The knitting tool of claim 3, wherein the transfer hook is provided, on both sides of its protrusion, with slide chamfers, which are guided on the shank in the cheek region.

11. The knitting tool of claim 3, wherein the extension has a width that is greater than the width of the hook.

12. The knitting tool of claim 1, wherein the loop-drawing needle and the transfer needle are supported on one another without prestressing.

13. A knitting machine, comprising: a cam, which includes a spring means that executes a relative motion with respect to the transfer needle of the knitting tool of claim 1, in order to press the transfer needle intermittently against the loop-drawing needle.

* * * * *